United States Patent [19]

Buckman

[11] 4,315,624

[45] Feb. 16, 1982

[54] GOLF BALL POSITION MARKER AND GROUND REPAIR TOOL

[75] Inventor: Charles E. Buckman, Summerville, S.C.

[73] Assignee: Wrightman Enterprises, Inc., Summerville, S.C.

[21] Appl. No.: 178,143

[22] Filed: Aug. 14, 1980

[51] Int. Cl.[3] ..... A63B 69/36

[52] U.S. Cl. ..... 273/32 A; 273/32 B

[58] Field of Search ..... 273/32 A, 32 R, 32 B; 224/918

[56] References Cited

U.S. PATENT DOCUMENTS

| | | | |
|---|---|---|---|
| 3,233,802 | 2/1966 | Ludwick | 273/32 A X |
| 3,339,300 | 9/1967 | Bury | 273/32 A |
| 3,774,913 | 11/1973 | Dien | 273/32 A X |
| 3,866,749 | 2/1975 | Stainer | 273/32 A X |
| 4,114,878 | 9/1978 | Hammond | 273/32 A |

FOREIGN PATENT DOCUMENTS

| | | | |
|---|---|---|---|
| 1369506 | 9/1974 | United Kingdom | 273/32 A |

*Primary Examiner*—George J. Marlo
*Attorney, Agent, or Firm*—Larry Harold Kline

[57] ABSTRACT

A device is disclosed for use in holding and placing a ball marker and in ground repair comprising a center section, a plurality of prongs extending from the center section, and a ball marker retaining section comprising a first indented ball marker retaining area, a second ball marker retaining area on the side opposite said first area, and a ball marker magnetically secured in each of said marker retaining areas.

2 Claims, 6 Drawing Figures

GOLF BALL POSITION MARKER AND GROUND REPAIR TOOL

This invention relates to sports apparatus and, more particularly, to the ball marking and ground repair function associated with the game of golf.

In playing the game of golf, a golf ball is hit onto the green near the golf hole. Many times the golf ball makes a mark or indentation on the green. When the golfer reaches the green, it is appropriate for the ball to be marked in accordance with the rules of golf and the ground to be repaired. The present invention is a device which is utilized as a combination ball marker and ground repair tool.

An object of the present invention is to provide a combination ball marker and ground repair tool.

Another object of the present invention is to provide a section of the tool on which a magnetized surface holds the ball marker.

A further object of the present invention on one configuration of the invention is to provide a slotted area within the tool which is magnetized and on which the ball marker is magnetically secured.

Still another object of the present invention on one configuration of the invention is for the slotted area to be utilized as a guide and a magnetic seat for the ball marker.

Another object of the present invention in one configuration of the invention is for the slot to have an open area through which the ball marker may slide off of the tool utilizing a slight pressure in order to be placed directly behind a golf ball in accordance with the rules of the game of golf.

Still another object of the present invention is to utilize the magnetized section of the tool to magnetically collect the ball marker from behind the golf ball on the green after the ball has been replaced.

A further object of the present invention is to perform the functions of positioning a ball marker on the green, collecting the ball marker from the green, and repairing the ground on the green with the same tool.

These and other objects and features of the invention will be apparent from the following description and appended claims.

Briefly, the invention is a device for use in holding and placing a ball marker and in ground repair comprising a center section, a plurality of prongs extending from the center section, and ball marker retaining section. The plurality of prongs are operative for use in ground repair. The ball marker retaining section is secured to the center section and is operative to hold a ball marker. The ball marker retaining section comprises a ball marker retaining area and a magnetic means secured onto the ball marker retaining area. The ball marker retaining area may be indented into the ball marker retaining section. The shoulder of the indented ball marker retaining area may form a guide for the movement of the ball marker. The ball marker retaining area may have an open end portion through which the ball marker may slide when being moved from the indented ball marker retaining area. A second ball marker retaining area can be added to the ball marker retaining section. A second magnetic means is secured onto the second ball marker retaining area and is operative to hold a second ball marker. The ball marker may be a variable-shaped ball marker. The indented ball marker retaining area and the shoulder of the indented ball marker retaining area will be of a variable shape conforming to the shape of the variable-shaped ball marker.

The invention will be more fully understood from the following detailed description and appended claims when taken with the drawings in which:

Figure 1:
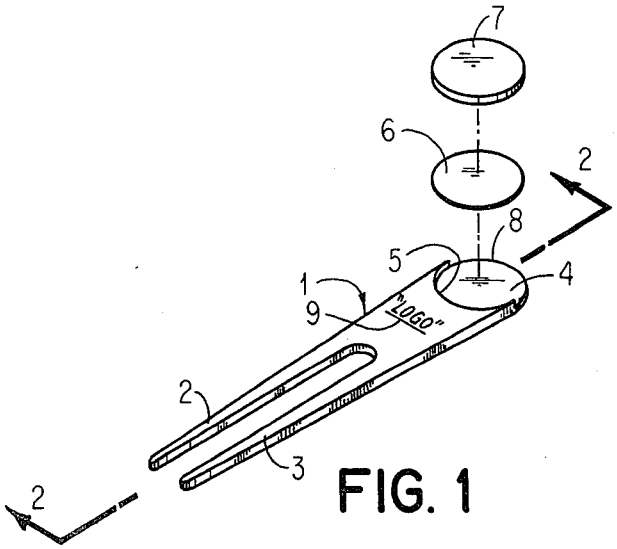
FIG. 1 is an exploded isometric view of a combination ball marker and ground repair tool utilizing a two-pronged ground repair section and a slotted marker placing area.

Referring now to the drawings, FIG. 1 is an exploded isometric view of a combination ball marker and ground repair tool 1 utilizing a ground repair section with prongs 2 and 3 and a marker retaining area 4. The marker retaining area 4 is indented from the surface of the tool 1 in a slot formed by the indented marker retaining area 4 and shoulder 5. Magnetic means 6 is secured onto marker retaining area 4. The marker 7 may be magnetically secured to the magnetic means 6. Advertising or logos may be placed at location 9 or elsewhere on the tool 1 or marker 7 for use as an advertising function.

Figure 2:
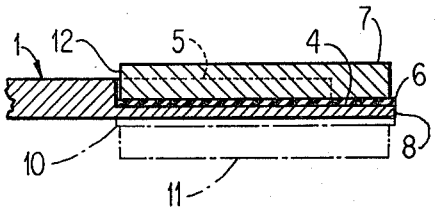
FIG. 2 is a partial sectional view taken at the section 2—2 of FIG. 1 showing also an optional marker and retaining means in dotted lines.

FIG. 2 is a partial sectional view taken at section 2—2 of FIG. 1. In FIG. 2 the exploded portions of FIG. 1 are unexploded. The marker 7 is magnetically secured to the magnetic means 6 which is secured to the marker retaining area 4. In use, the marker 7 may be pushed from marker end 12 in order for the marker 7 to slide off of the magnetic means 6 in order to be detached from tool 1 and be placed where desired. The marker retaining area 4 is on the end 8 of tool 1 opposite from the tips of prongs 2 and 3.

FIG. 2 also shows in dotted lines optional marker retaining magnetic means 10 which might be utilized on tool 1 in order to magnetically hold an optional marker 11. Optional marker retaining magnetic means 10 is shown placed onto the bottom surface of tool 1, but may also be increased, if desired.

Figure 3:
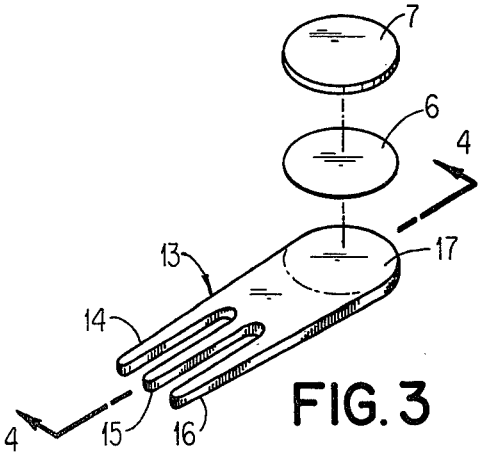
FIG. 3 is an exploded isometric view of a combination ball marker and ground repair tool utilizing a three-pronged ground repair section and a surface mounted marker retaining area.

FIG. 3 is an exploded isometric view of a combination ball marker and ground repair tool 13 utilizing three prongs, prongs 14, 15, and 16. Tool 13 has a marker area 17 on which magnetic means 6 may be secured. Marker 7 may be magnetically secured to magnetic means 6. The combination ball marker and ground repair tool 13 can be used with any plurality of prongs desired. In FIG. 2, prongs 2 and 3 are shown. In FIG. 3, prongs 14, 15, and 16 are shown. More prongs can be utilized, if desired. One prong with a plurality of teeth may be utilized, if desired. The ground repair portion of the tool 13 could be considered to be a plurality of teeth emanating from the tool 13.

Figure 4:
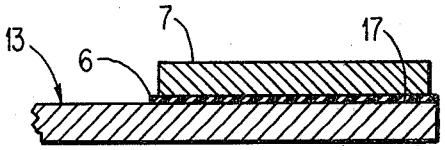
FIG. 4 is a partial sectional view at section 4—4 of FIG. 3.

FIG. 4 is a partial sectional view at section 4—4 of FIG. 3. The exploded portions of FIG. 3 are unexploded. Magnetic means 6 is secured to the marker area 17. Marker 7 is magnetically secured to magnetic means 6. The marker 7 again may be pushed or slid from the magnetic means 6 in order to be placed onto the green. The marker 7 may then be collected from the green by placing the tool 13 and, specifically, the magnetic means 6 over and against the marker 7. The stronger the magnetic means 6 utilized, the less pressure and distance required by the marker 7 and the magnetic means 6 to collect the marker 7.

Figure 5:
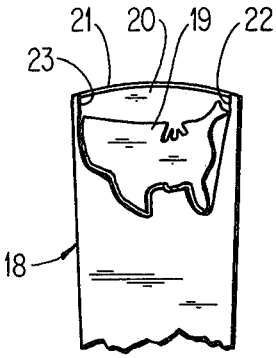
FIG. 5 is a partial plan view of a variable-shaped ball marker in a combination ball marker and ground repair tool illustrating that variable-shaped ball markers may be utilized with the present invention.

FIG. 5 is a partial plan view of a variable-shaped ball marker 19 utilized on a combination ball marker and ground repair tool 18. The only section of tool 18 shown is the end on which the variable-shaped marker 19 is secured. Variable shaped marker 19 is shown in a pattern similar to the map of the territorial states in the United States of America. This shape is merely illustrative of the multitude of variable-shaped markers 19 that might be utilized. A sliding guide is formed by guides 22 and 23. Magnetic means 20 is placed onto tool 18, either on the surface of tool 18 or in an indented position. The sliding guides 22 and 23 may be placed on the surface of tool 18 or may be utilized in an indented position. The variable-shaped marker 19 may be placed on the magnetic means 20 without use of the sliding guides 22 and 23 or the outline formed by the extension of the guides 22 and 23. The variable-shaped marker 19 may be utilized as in FIG. 3 in which the magnetic means 6 is placed directly onto the marker area 17. As shown in FIG. 5, the variable-shaped marker 19 would slide out of the open end portion 21 of tool 18. When the variable-shaped marker 19 is replaced onto the tool 18, the magnetic means 20 will collect the variable-shaped marker 19 and secure it onto tool 18.

Figure 6:
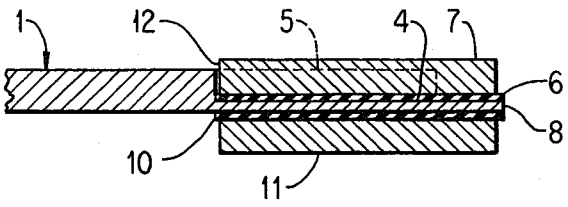
FIG. 6 is a sectional view of the combination ball marker and ground repair tool showing an optional marker and retaining means.

FIG. 6 is a sectional view of the combination ball marker and ground repair tool showing an optional marker and retaining means. The marker 7 is magnetically secured to the magnetic means 6 which is secured to the marker retaining area 4. In use, the marker 7 may be pushed from marker end 12 in order for the marker 7 to slide off of the magnetic means 6 in order to be detached from tool 1 and be placed where desired. The marker retaining area 4 is on the end 8 of tool 1 opposite from the tips of prongs 2 and 3. Retaining magnetic means 10 might be utilized on tool 1 in order to magnetically hold an optional marker 11. Optional marker retaining magnetic means 10 is shown placed onto the bottom surface of tool 1, but may also be recessed, if desired.

The magnetic means 6, 10, and 20 may be any type of magnetic means. The magnetic means could be a magnetic tape in which the side of the tape is secured to the retaining area below. The magnetic means could be a magnetic insert secured within or on the tool. The magnetic means could be a metal with magnetic properties or which is magnetized and becomes a portion of the tool.

The tool may be made from any desired material which can perform the functions defined herein. When a slot is utilized as a guide for the marker, the slot allows the fairly straight ejection of the ball marker from the tool. This gives a great convenience to placing the ball marker in a position directly behind the golf ball in accordance with the rules of the game of golf. Utilizing the indented slot may also add to the longetivity of the tool by protecting the magnetic portion from possible deterioration. When the slot is indented, the ball marker is only partially exposed over the surface of the tool aiding in the aesthetic appearance of the tool and adding the function of utilization of the slot as a guide and a seat for the ball marker. The present tool is convenient and easy to use. The tool allows an individual to repair ball indentation marks on a golf green and to mark the position of the ball with the same tool. The tool eliminates the need for the golfer to carry extra ball markers and to continually hunt for small marking devices. The marker stays positioned on the tool magnetically preventing the loss of the ball marker. The tool eliminates the necessity of physically placing the ball marker behind the golf ball with the hand. With this tool, the ball marker can be slid into place eliminating the possibility of moving the ball which might incur a penalty to the golfer. The end of the slotted section should have an open portion such as open end portion 21 on tool 18 so that the marker may be slid from the slotted section. The tool can be utilized for advertising purposes advertising slogans, logos, or messages which can be placed in a location such as location 9 in FIG. 1 and the tools handed, given, or presented by those seeking such advertisements.

When the ball marker 7 is collected by the tool 1 from the ground, it is in position for future use. No extra re-positioning effort by the golfer to place the ball marker 7 in proper position for future use is necessary.

The present invention meets its objectives by providing a combination ball marker and ground repair tool on which a magnetized surface holds the ball marker. The invention also provides a slotted area within the tool which is magnetized and on which the ball marker is magnetically secured. One configuration of the invention provides a slotted area to be utilized as a guide and a magnetic seat for the ball marker. Also, one configuration provides for the slot to have an open area through which the ball marker may slide off of the tool utilizing a slight pressure in order to be placed directly behind a golf ball in accordance with the rules of the game of golf. The invention also provides a magnetized section of the tool to magnetically collect the ball marker from behind the golf ball on the green after the ball has been replaced. The present invention performs the functions of positioning a ball marker on the green, collecting the ball marker from the green, and repairing the ground on the green with the same tool.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

I claim:

1. A device for use in holding and placing a ball marker and in ground repair comprising:

a. a ball marker structurally comprising a substantially flat bottom, a substantially flat top, and a body extending from said substantially flat bottom to said substantially flat top;

b. a structure containing a center section;

c. a plurality of prongs extending from said center section and operative for use in ground repair;

d. a ball marker retaining section secured to said center section and operative to hold said ball marker comprising:

1. a ball marker retaining area, the approximate shape and size of said ball marker and indented into said ball marker retaining section with the shoulder of said indented ball marker retaining area forming a guide for the movement of said ball marker, said ball marker retaining area being of appropriate depth so that said ball marker would extend above said structure which includes said ball marker retaining section wherein movement of an object from said center section toward said ball marker retaining section would encounter the perimeter of said ball marker causing said ball marker to slide outward from said device; and 2. a magnet secured onto said ball marker retaining area;

e. a second ball marker retaining area which is the side of said ball marker retaining section opposite from the side of said ball marker retaining section containing said indented ball marker retaining area; and f. a second magnet secured onto said second ball marker retaining area and operative to hold a second ball marker.

2. A device according to claim 1 further comprising a second ball marker sized and shaped to fit into said second ball marker retaining area.

* * * * *